US011421535B2

(12) United States Patent
Yokoyama et al.

(10) Patent No.: US 11,421,535 B2
(45) Date of Patent: Aug. 23, 2022

(54) TURBINE BLADE, TURBOCHARGER, AND METHOD OF PRODUCING TURBINE BLADE

(71) Applicant: MITSUBISHI HEAVY INDUSTRIES ENGINE & TURBOCHARGER, LTD., Sagamihara (JP)

(72) Inventors: Takao Yokoyama, Tokyo (JP); Toru Hoshi, Tokyo (JP); Toyotaka Yoshida, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 286 days.

(21) Appl. No.: 16/605,370

(22) PCT Filed: Oct. 31, 2017

(86) PCT No.: PCT/JP2017/039274
§ 371 (c)(1),
(2) Date: Oct. 15, 2019

(87) PCT Pub. No.: WO2019/087281
PCT Pub. Date: May 9, 2019

(65) Prior Publication Data
US 2020/0040737 A1 Feb. 6, 2020

(51) Int. Cl.
*F01D 5/14* (2006.01)

(52) U.S. Cl.
CPC ..... *F01D 5/141* (2013.01); *F01D 5/147* (2013.01); *F05D 2220/36* (2013.01)

(58) Field of Classification Search
CPC . F01D 5/14; F01D 5/141; F01D 5/147; F05D 2220/36
See application file for complete search history.

(56) References Cited

U.S. PATENT DOCUMENTS 4,108,573 A * 8/1978 Wagner ..... F01D 5/141 416/236 A
6,565,324 B1 * 5/2003 Phillipsen ..... F01D 5/141 416/236 R (Continued)

FOREIGN PATENT DOCUMENTS

CN 104334854 A 2/2015
CN 105556129 A 5/2016

(Continued)

OTHER PUBLICATIONS

Office Action dated Jan. 6, 2021 issued in counterpart Chinese Application No. 201780090887.X.

(Continued)

*Primary Examiner* — Juan G Flores
*Assistant Examiner* — Joshua R Beebe
(74) *Attorney, Agent, or Firm* — Birch, Stewart, Kolasch & Birch, LLP

(57) ABSTRACT

A turbine blade configured to be coupled to a rotational shaft and rotated around an axis includes: a hub having a hub surface which is inclined with respect to the axis in a cross section along the axis; a rotor blade disposed on the hub surface; and at least one rib formed on a blade surface of the rotor blade, the at least one rib extending in a direction which intersects with a span direction of the rotor blade in a meridional plane of the rotor blade.

11 Claims, 16 Drawing Sheets

(56) References Cited

U.S. PATENT DOCUMENTS

| | | | | |
|---|---|---|---|---|
| 2014/0099476 | A1 | 4/2014 | Subramanian et al. | |
| 2014/0255198 | A1* | 9/2014 | El-Wardany | B22F 10/20 416/229 A |
| 2014/0348664 | A1 | 11/2014 | Jan et al. | |
| 2015/0118080 | A1* | 4/2015 | Dextraze | F01D 5/143 417/406 |
| 2015/0381802 | A1 | 12/2015 | Yoshida et al. | |
| 2016/0123345 | A1* | 5/2016 | Scotti Del Greco | F04D 29/624 415/208.1 |
| 2016/0312787 | A1* | 10/2016 | Sato | C22C 21/02 |
| 2017/0211168 | A1* | 7/2017 | Liu | C22C 45/08 |

FOREIGN PATENT DOCUMENTS

| | | | | |
|---|---|---|---|---|
| JP | 60-134833 | U | 9/1985 | |
| JP | 63-45002 | U | 3/1988 | |
| JP | 8-21398 | A | 1/1996 | |
| JP | 2003-129882 | A | 5/2003 | |
| JP | 2009-243395 | A | 10/2009 | |
| JP | 2015-194137 | A | 11/2015 | |
| JP | 2016-502589 | A | 1/2016 | |
| JP | 2016-37901 | A | 3/2016 | |
| WO | WO 2014/128898 | A1 | 8/2014 | |
| WO | WO-2015048230 | A1 * | 4/2015 | F04D 29/30 |

OTHER PUBLICATIONS

Extended European Search Report dated May 28, 2020, for European Application No. 17930422.5.

English translation of the Written Opinion of the International Searching Authonty dated Dec. 23, 2019, for International Application No. PCT/JP2017/039274.

International Search Report, dated Nov. 28, 2017, for International Application No. PCT/JP2017/039274.

Office Action dated Jun. 30, 2020 issued in counterpart Japanese Application No. 2019-550031 with machine translation.

* cited by examiner

TURBINE BLADE, TURBOCHARGER, AND METHOD OF PRODUCING TURBINE BLADE

TECHNICAL FIELD

The present disclosure relates to a turbine blade, a turbocharger, and a method of producing a turbine blade.

BACKGROUND ART

In an engine used for an automobile and the like, an exhaust turbocharger is widely known, in which a turbine is rotated by exhaust gas energy of an engine and a centrifugal compressor directly coupled to a turbine via a rotation shaft compresses intake air and supplies the engine with the intake air, to improve the output of the engine.

In such a turbine used for an exhaust turbocharger, exhaust gas serving as a working fluid flows from the leading edge toward the trailing edge of the turbine blade. However, for instance, if a flow of a working fluid or the like called secondary flow that flows along the blade surface from the hub toward the shroud of the turbine occurs, the pressure loss of the working fluid increases, and the turbine efficiency decreases. Thus, it is required to suppress occurrence of secondary flow of the working fluid.

Furthermore, in a turbine used for an exhaust turbocharger, vibration may occur on the turbine blade. When vibration occurs on the turbine blade, the turbine blade may break, and thus it is required to suppress vibration of the turbine blade.

Thus, for instance, a turbine configured to suppress vibration of a turbine blade is known (see Patent Document 1).

CITATION LIST

Patent Literature

Patent Document 1: WO2014/128898A
Patent Document 2: JP2003-129862A
Patent Document 3: JP2015-194137A
Patent Document 4: JP2016-502589A (translation of a PCT application)

SUMMARY

Problems to be Solved

The turbines described in the above Patent Documents include a blade-thickness changing portion where the blade thickness of the cross-sectional shape at the middle portion of the vane height increases rapidly relative to the blade thickness of the leading edge side, in order to adjust the natural frequency of the rotor blade and suppress vibration of the rotor blade.

However, the above described Patent Documents do not disclose any configuration for suppressing secondary flow of the working fluid.

Furthermore, the above described Patent Documents 2 to 4 disclose techniques to produce a turbine blade of an axial-flow turbine such as a gas turbine and a steam turbine, by metal additive manufacturing. However, the inventions disclosed in the above Patent Documents are about producing a turbine blade, which is a part of an axial turbine, by metal additive manufacturing, and not about producing an entire axial-flow turbine including a rotor.

In view of the above, an object of at least one embodiment of the present invention is to provide a turbine blade, a turbocharger, and a method of producing a turbine blade, whereby it is possible to suppress secondary flow of a working fluid.

Solution to the Problems (1) According to at least one embodiment of the present invention, a turbine blade configured to be coupled to a rotational shaft and rotated around an axis includes: a hub having a hub surface which is inclined with respect to the axis in a cross section along the axis; a rotor blade disposed on the hub surface; at least one rib formed on a blade surface of the rotor blade, the at least one rib extending in a direction which intersects with a span direction of the rotor blade in a meridional plane of the rotor blade.

With the above configuration (1), the at least one rib extends in a direction that intersects with the span direction of the rotor blade, and thus it is possible to suppress secondary flow in the span direction along the blade surface of the rotor blade. Accordingly, it is possible to reduce pressure loss of the working fluid, and improve the turbine efficiency. Furthermore, with the above configuration (1), the rib reinforces the rotor blade, and thus it is possible to suppress vibration that occurs on the rotor blade.

(2) In some embodiments, in the above configuration (1), in the meridional plane of the rotor blade, the at least one rib has an upstream end formed so as to be oriented in a first direction which is a direction away from the axis and a downstream end formed so as to be oriented in a second direction, and a relationship $\theta 1 > \theta 2$ is satisfied, where $\theta 1$ is an angular degree of an acute angle formed by the first direction and a direction parallel to the axis, and $\theta 2$ is an angular degree of an acute angle formed by the second direction and the direction parallel to the axis.

With the above configuration (2), the upstream end of the rib is oriented toward the upstream side of the flow of the working fluid and the downstream end of the rib is oriented toward the downstream side of the flow of the working fluid. Thus, the at least one rib has a shape conforming to the flow of the working fluid, and thereby it is possible to reduce pressure loss of the working fluid.

(3) In some embodiments, in the above configuration (1) or (2), the at least one rib has an arc shape protruding toward the axis in the meridional plane of the rotor blade.

With the above configuration (3), the rib has an arc shape that protrudes toward the axis, and thus the at least one rib has a shape along the flow of the working fluid, whereby it is possible to reduce pressure loss of the working fluid.

(4) In some embodiments, in any one of the above configurations (1) to (3), at least a part of the at least one rib extends along a meridional line of the rotor blade in the meridional plane of the rotor blade.

With the above configuration (4), at least a part of the rib extends along the meridional line of the rotor blade, and thus the at least one rib has a shape conforming to the flow of the working fluid, whereby it is possible to reduce pressure loss of the working fluid.

(5) In some embodiments, in any one of the above configurations (1) to (4), the at least one rib is configured to satisfy a relationship $L \geq 2t$, where L is a length of the rib in the meridional plane and 't' is a thickness of the rib.

With the above configuration (5), it is possible to suppress the secondary flow in a broad range with the rib having the length L. Furthermore, with the thickness 't' of the rib satisfying the relationship $L \geq 2t$, it is possible to suppress the thickness of the rib and suppress the weight increase of the turbine blade despite formation of the rib.

(6) In some embodiments, in any one of the above configurations (1) to (5), the at least one rib has an oblique portion whose height increases gradually from an upstream end of the at least one rib toward a downstream side.

With the above configuration (6), the rib has an oblique portion whose height gradually increases from the upstream end toward the downstream side, and thus it is possible to reduce pressure loss of the working fluid compared to a rib that does not have an oblique portion.

(7) In some embodiments, in any one of the above configurations (1) to (6), the at least one rib comprises a plurality of ribs.

With the above configuration (7), compared to a case where a single long rib is provided, it is possible to suppress the weight increase of the turbine blade despite formation of the rib, by forming short ribs at a plurality of locations where secondary flow can be suppressed effectively.

(8) In some embodiments, in any one of the above configurations (1) to (7), in the meridional plane of the rotor blade, the at least one rib is formed on a position which satisfies a relationship $Hl>0.5\times Hb$, where Hb is an entire height of the rotor blade in the span direction and Hl is a height from the hub surface to the at least one rib in the span direction.

The influence of loss due to secondary flow is more significant at the side of the tip portion of the rotor blade than at the side of the root portion of the rotor blade. Further, the length of the rotor blade in the meridional direction decreases from the root portion toward the tip portion. Thus, even though the rib has the same length, the influence of loss due to secondary flow can be suppressed more effectively when the rib is formed at the side of the end portion, compared to a case where the rib is formed at the side of the root portion.

In this regard, with the above configuration (8), the at least one rib is formed on a position that satisfies $Hl>0.5\times Hb$, and thus the rib is formed on a position closer to the tip portion than to the root portion on the blade surface, and thus it is possible to suppress the influence of loss due to secondary flow effectively.

Furthermore, vibration that occurs on the rotor blade tends to deform more largely at the side of the tip portion, and thus it is possible to suppress vibration that occurs on the rotor blade effectively by forming the at least one rib on a position closer to the tip portion than to the root portion on the blade surface.

(9) In some embodiments, in the above configuration (8), the at least one rib is formed on a suction-surface side blade surface of the rotor blade.

At the suction-surface side surface of the rotor blade, secondary flow flowing along the blade surface from the root portion toward the end portion causes problems. In this regard, with the above configuration (9), it is possible to suppress secondary flow at the suction-surface side and suppress loss.

(10) In some embodiments, in the above configuration (8), the at least one rib is formed near a tip portion of a pressure-surface side blade surface of the rotor blade.

A tip clearance exists between the tip portion of the rotor blade and the shroud. At the pressure-surface side of the rotor blade, clearance flow causes problems, in particular, when a working fluid flows to the suction surface from the pressure surface via the tip clearance. Occurrence of clearance flow leads to deterioration of the turbine efficiency and generation of loss.

In this regard, with the above configuration (10), it is possible to suppress clearance flow and suppress loss.

(11) In some embodiments, in the above configuration (10), in the meridional plane of the rotor blade, when a reference meridional line is a meridional line which passes a region of the blade surface where the at least one rib is formed, the region includes a section where a curve degree of the blade surface on the reference meridional line is maximum.

The above described clearance flow tends to increase at a section where the curve degree of the blade surface on the meridional line is large.

In this regard, with the above configuration (11), the rib is formed on a position with a high rate of clearance flow, and thus it is possible to suppress clearance flow and suppress loss.

(12) In some embodiments, in any one of the above configurations (8) to (11), the at least one rib includes: a suction-surface side rib formed on a suction-surface side blade surface of the rotor blade; and a pressure-surface side rib formed on a pressure-surface side blade surface of the rotor blade. In the meridional plane of the rotor blade, a relationship $Hln<Hlp$ is satisfied, where Hln is a height from the hub surface to the suction-surface side rib in the span direction and Hlp is a height from the hub surface to the pressure-surface side rib in the span direction.

With the above configuration (12), it is possible to suppress secondary flow at the side of the suction surface with the suction-surface side rib and reduce loss. Further, with the above configuration (12), the pressure-surface side rib is formed closer to the tip portion of the rotor blade with respect to the suction-surface side rib, and thereby it is possible to suppress the above described clearance flow effectively and reduce loss. Furthermore, with the suction-surface side rib and the pressure-surface side rib having different heights from the hub surface in the span direction, it is possible to suppress vibration in a broad range of the rotor blade.

(13) In some embodiments, in any one of the above configurations (1) to (12), the rotor blade and the rib comprise the same metal material, and the at least one rib has a smaller density than the rotor blade.

In the turbine blade, the strength required for the rotor blade and the strength required for the rib are different. That is, the rotor blade needs to have a high strength to resist a centrifugal force.

On the other side, the rib formed on the rotor blade does not need to be as strong as the rotor blade, for the rotor blade has a high strength. Thus, it is desirable to suppress the weight of the rib to suppress weight increase of the turbine blade.

Furthermore, in a case where the rotor blade and the rib are formed integrally in the turbine blade, to suppress the weight of the rib, the density of the rib may be reduced compared to that of the rotor blade by changing the density between the rib and the rotor blade.

In this regard, with the above configuration (13), the rib has a smaller density than the rotor blade, and thereby it is possible to suppress the weight of the rib, and suppress weight increase of the turbine blade.

(14) According to at least one embodiment of the present invention, a turbocharger includes: a rotational shaft; a compressor wheel coupled to a first end side of the rotational shaft; and the turbine blade according to any one of the above (1) to (13), coupled to a second end side of the rotational shaft.

With the above configuration (14), the turbocharger is provided with the turbine blade described in the above (1), and thus it is possible to improve the turbine efficiency of the turbocharger. Furthermore, with the above configuration (14), the turbocharger has the turbine blade with the above configuration (1), and thus it is possible to suppress vibration that occurs on the rotor blade.

(15) According to at least one embodiment of the present invention, a method of producing the turbine blade according to any one of the above (1) to (13) includes: forming the hub, the rotor blade, and the rib integrally by additive manufacturing of metal powder.

For instance, when producing a turbine blade by fine casing, wax is injected into a mold, and a wax mold is produced. The wax mold needs to be removed from the mold, and thus a protruding portion or the like that extends in a direction that intersects with the direction of mold removal cannot be formed on the position of the wax mold that corresponds to the surface of the turbine blade. Thus, fine casting is not suitable to producing a turbine blade that has a rib formed on the blade surface extending in a direction that intersects with the span direction of the rotor blade in the meridional plane of the rotor blade as in the above configuration (1).

In this regard, according to the above method (15), additive manufacturing of metal powder makes it possible to produce a turbine blade including a rib by integrally forming the hub, the rotor blade, and the rib.

Advantageous Effects

According to at least one embodiment of the present invention, it is possible to improve the turbine efficiency.

BRIEF DESCRIPTION OF DRAWINGS

FIG. 3A, is a schematic view of the meridional shape of a rotor blade according to an embodiment, and FIG. 3B is a schematic cross-sectional view of the rotor blade shown in FIG. 3A, as seen from a flow direction of exhaust gas.

FIG. 4A is a schematic view of the meridional shape of a rotor blade according to an embodiment, and FIG. 4B is a schematic cross-sectional view of the rotor blade shown in FIG. 4A, as seen from a flow direction of exhaust gas.

FIG. 5A is a schematic view of the meridional shape of a rotor blade according to an embodiment, and FIG. 5B is a schematic cross-sectional view of the rotor blade shown in FIG. 5A, as seen from a flow direction of exhaust gas.

FIG. 6A is a schematic view of the meridional shape of a rotor blade according to an embodiment, and FIG. 6B is a schematic cross-sectional view of the rotor blade shown in FIG. 6A, as seen from a flow direction of exhaust gas.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
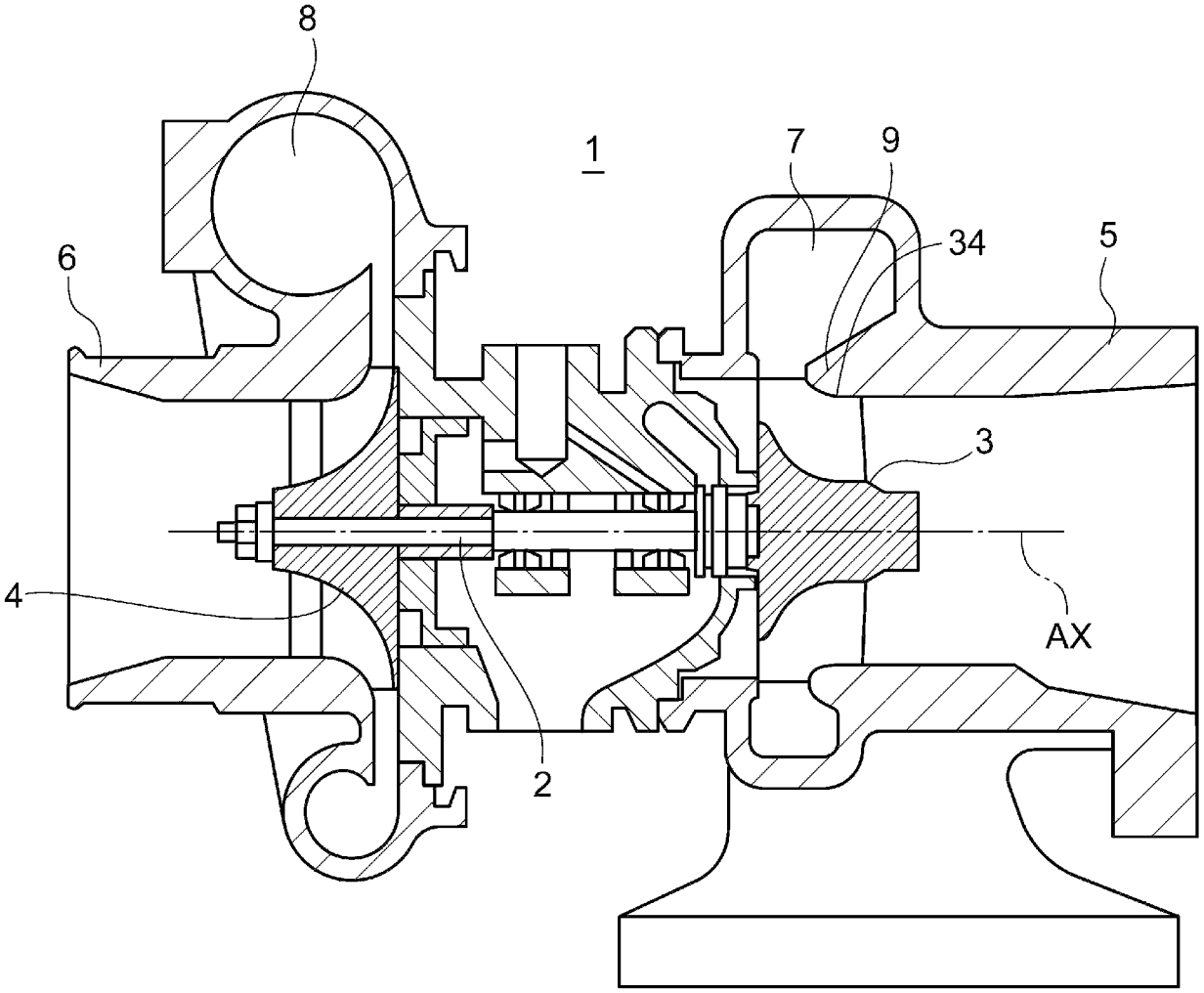
FIG. 1 is a cross-sectional view showing an example of a turbocharger according to some embodiments.

FIG. 1 is a cross-sectional view showing an example of a turbocharger 1 according to some embodiments.

According to some embodiments, the turbocharger 1 is a device for supercharging intake air of an engine, mounted to a vehicle such as a car.

The turbocharger 1 includes a turbine wheel (turbine blade) 3 and a compressor wheel 4 coupled to one another via a rotor shaft 2 being a rotational shaft, a turbine housing 5 that houses the turbine blade 3, and a compressor housing 6 that houses the compressor wheel 4. Further, the turbine housing 5 has a scroll 7. The compressor housing 6 has a scroll 8.

Further, a shroud 9 is formed on the outer peripheral side of the turbine blade 3 of the turbine housing 5 so as to cover the turbine blade 3.

Figure 2:
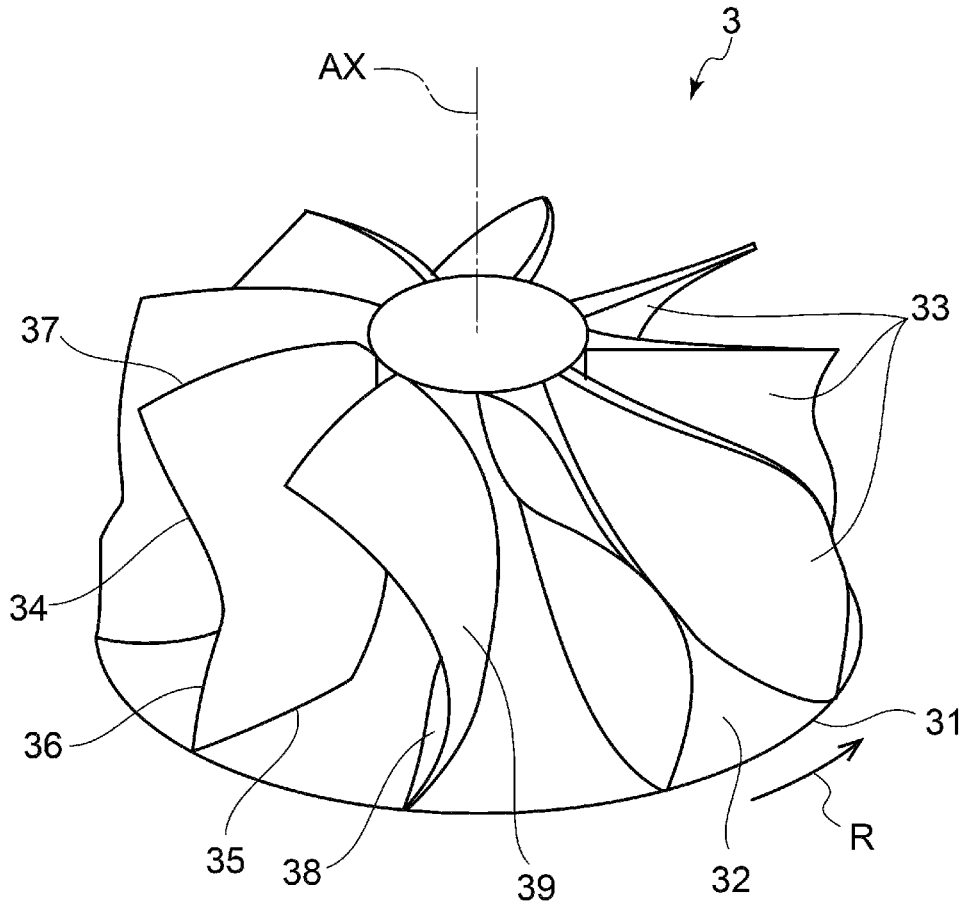
FIG. 2 is a perspective external view of a turbine blade according to some embodiments.

FIG. 2 is a perspective external view of the turbine blade 3 according to some embodiments.

According to some embodiments, the turbine blade 3 is coupled to the rotor shaft (rotational shaft) 2 and configured to be rotated around the axis AX. According to some embodiments, the turbine blade 3 includes a hub 31 that has, in a cross section along the axis AX, a hub surface 32 inclined from the axis AX and a plurality of rotor blades 33 disposed on the hub surface 32. While the turbine blade 3 shown in FIG. 2 is a radial turbine, the turbine blade 3 may be a mixed-flow turbine. Furthermore, illustration of the rib described below is omitted from FIG. 2. In FIG. 2, arrow R indicates the rotational direction of the turbine blade 3. A plurality of rotor blades 33 are disposed at intervals in the circumferential direction of the turbine blade 3.

In the turbocharger 1 having the above configuration, exhaust gas serving as a working fluid flows from the leading edge 36 toward the trailing edge 37 of the turbine blade 3. However, for instance, if flow of a working fluid or the like called secondary flow that flows along the blade surface from the hub surface 32 toward the shroud 9 occurs, the pressure loss of the working fluid increases, and the turbine efficiency decreases. Thus, it is required to suppress occurrence of secondary flow of the working fluid.

Furthermore, in the turbocharger 1, vibration may occur on the rotor blades 33 of the turbine blade 3. Vibration that occurs on the rotor blades 33 may cause damage to the turbine blade 3, and thus it is required to suppress vibration of the rotor blades 33.

Thus, according to some embodiments, the turbine blade 3 is configured to suppress the above described secondary flow and vibration of the rotor blades 33 with ribs formed on the blade surfaces of the rotor blades 33. Hereinafter, the ribs of the turbine blade 3 according to some embodiments will be described.

FIGS. 3 to 11 are each a diagram schematically illustrating the shape of the rotor blade 33 according to an embodiment.

Figure 7:
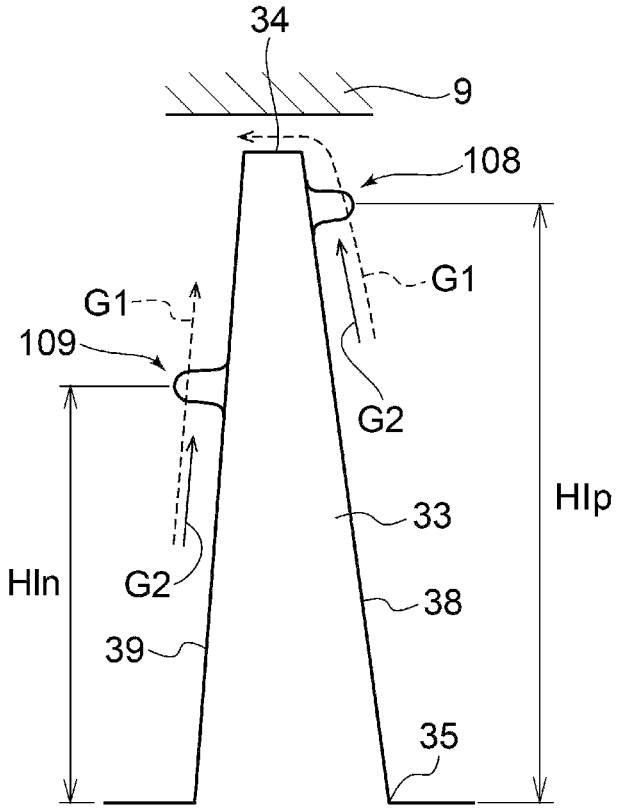
FIG. 7 is a schematic view showing the shape of a rotor blade according to an embodiment, and a schematic cross-sectional view of the rotor blade according to an embodiment as seen from a flow direction of exhaust gas.
Figure 8:
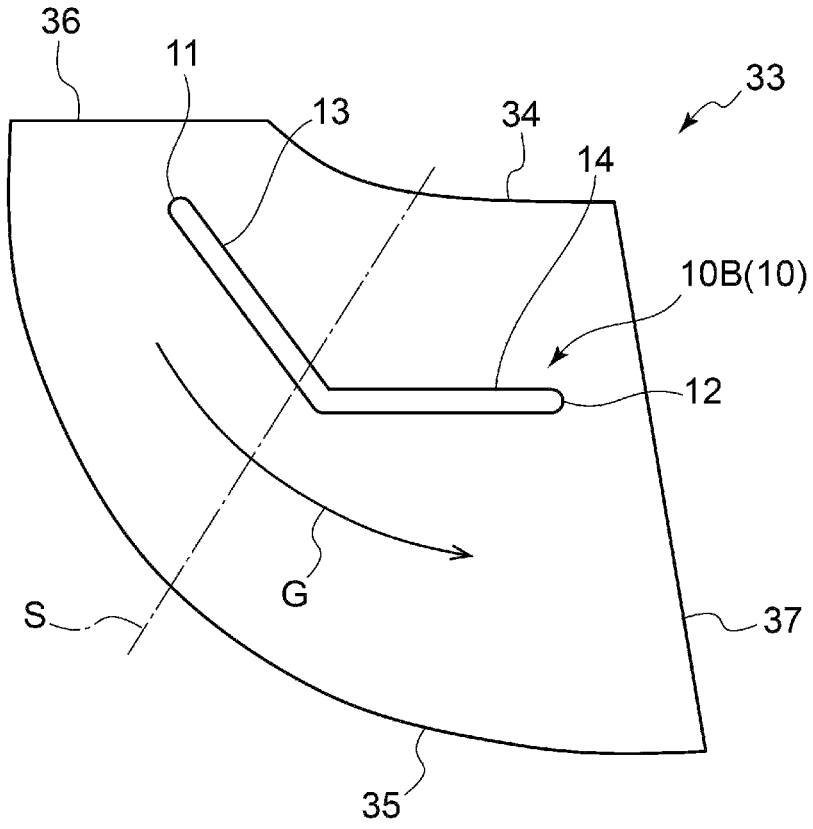
FIG. 8 is a schematic view showing the shape of a rotor blade according to an embodiment, and a schematic cross-sectional view of the meridional shape of the rotor blade according to an embodiment.
Figure 9:
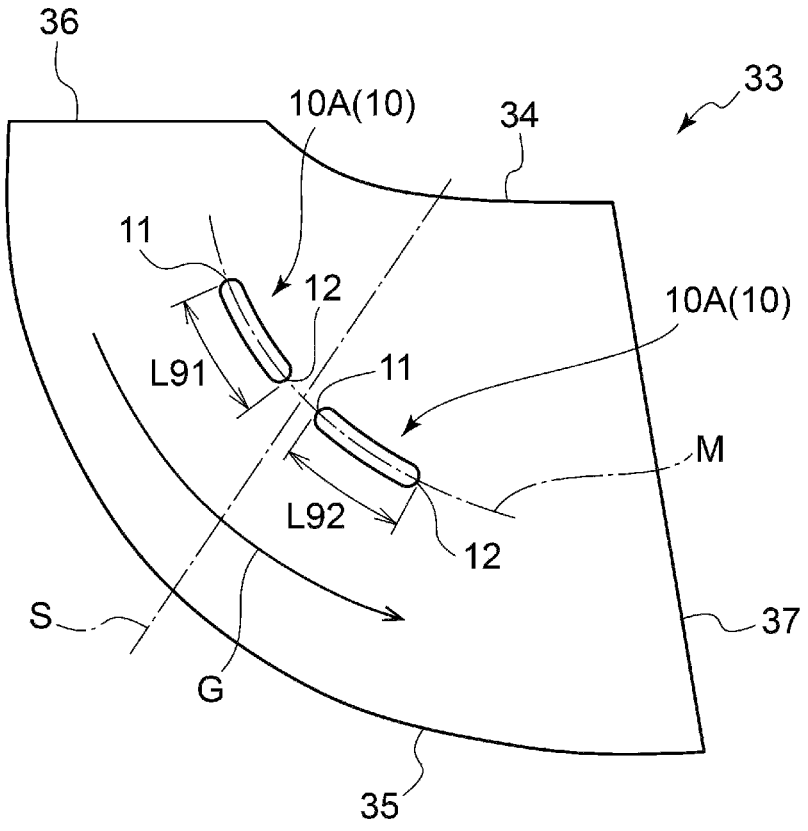
FIG. 9 is a schematic view of the meridional shape of a rotor blade according to an embodiment where a plurality of ribs extend in series along a flow of exhaust gas.
Figure 10:
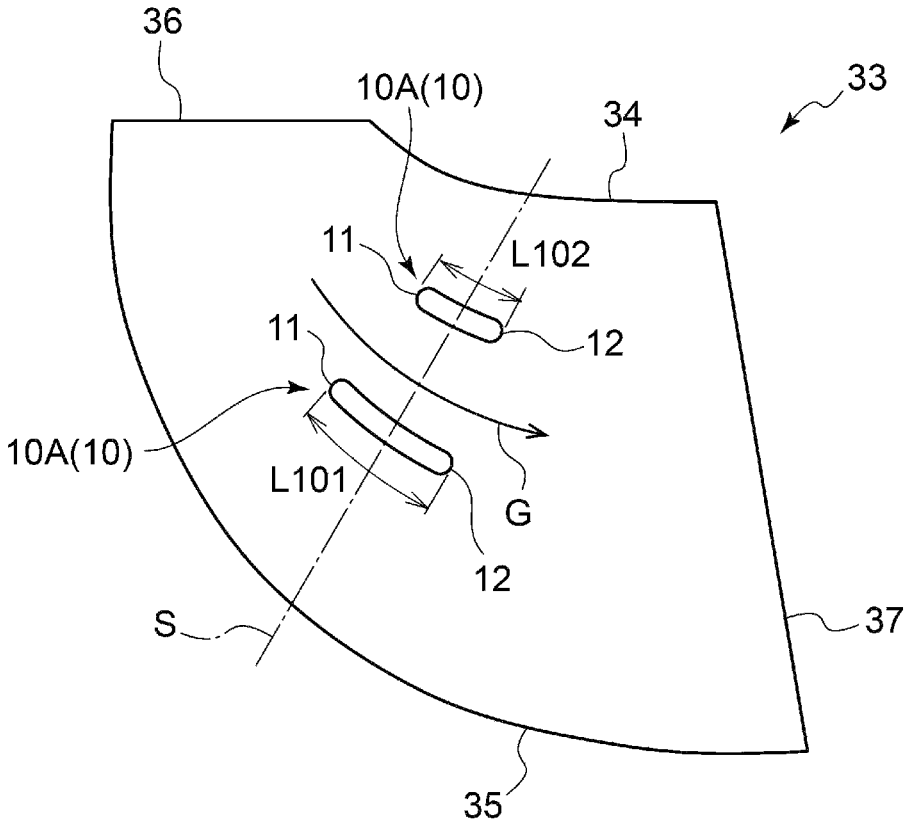
FIG. 10 is a schematic view of the meridional shape of a rotor blade according to an embodiment where a plurality of ribs extend in parallel along a flow of exhaust gas.
Figure 11:
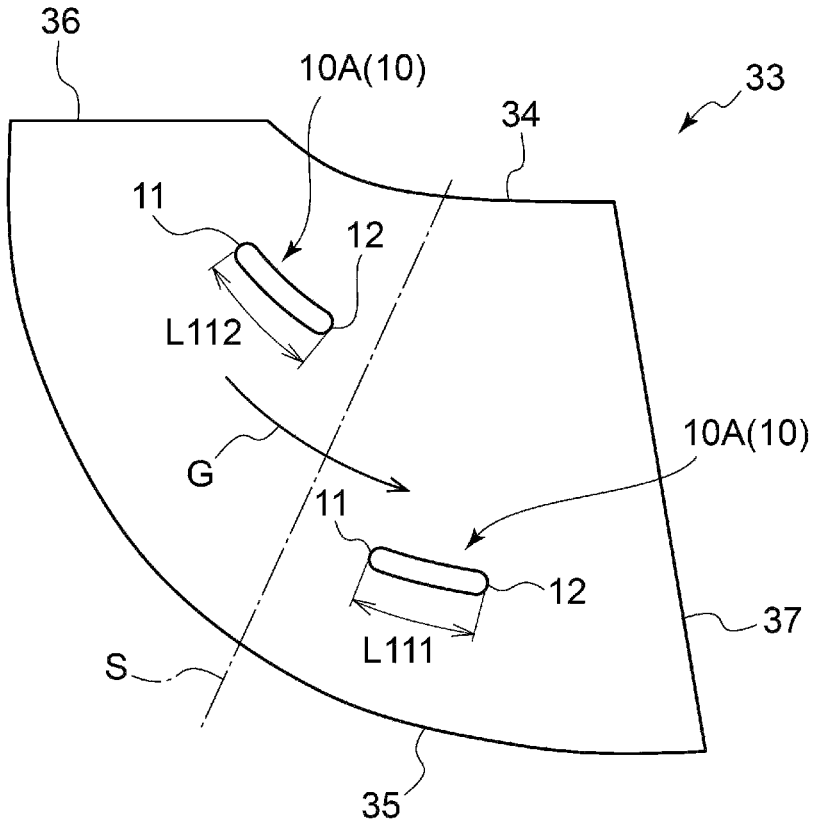
FIG. 11 is a schematic view of the meridional shape of the rotor blade according to an embodiment where a plurality of ribs are disposed at different positions in the span direction.

FIGS. 3A to 6A are each a schematic view showing the meridional shape of a rotor blade 33 according to an embodiment. FIGS. 3B to 6B are each a schematic cross-sectional view of the rotor blade 33 shown in FIGS. 3A to 6A, respectively, as seen from a flow direction of exhaust gas. Furthermore, FIG. 7 is a schematic cross-sectional view of a rotor blade 33 according to an embodiment, as seen from a flow direction of exhaust gas. FIG. 8 is a schematic view of the meridional shape of the rotor blade 33 according to an embodiment. FIG. 9 is a schematic view of the meridional shape of the rotor blade 33 according to an embodiment where a plurality of ribs extend in series along a flow of exhaust gas. FIG. 10 is a schematic view of the meridional shape of the rotor blade 33 according to an embodiment where a plurality of ribs extend in parallel along a flow of exhaust gas. FIG. 11 is a schematic view of the meridional shape of the rotor blade 33 according to an embodiment described below, where a plurality of ribs are disposed at different positions in the span direction.

As depicted in FIGS. 3 to 7 and FIGS. 9 to 11, in some embodiments, at least one rib 10A is formed on the blade surface of the rotor blade 33, and the at least one rib 10A extends along the flow direction G of exhaust gas and protrudes from the blade surface. As depicted in FIG. 8, in an embodiment, the rotor blade 33 has a rib 10B formed on the blade surface, and the rib 10B extends along the flow direction of exhaust gas and protrudes from the blade surface.

In the following description, when the rib 10A and the rib 10B do not need to be differentiated, the suffixed alphabet of the reference numeral is omitted and the rib is merely referred to as the rib 10.

Each of the ribs 10 extends, in the meridional plane of the rotor blade 33, in a direction that intersects with the span direction of the rotor blade 33.

Figure 3A:
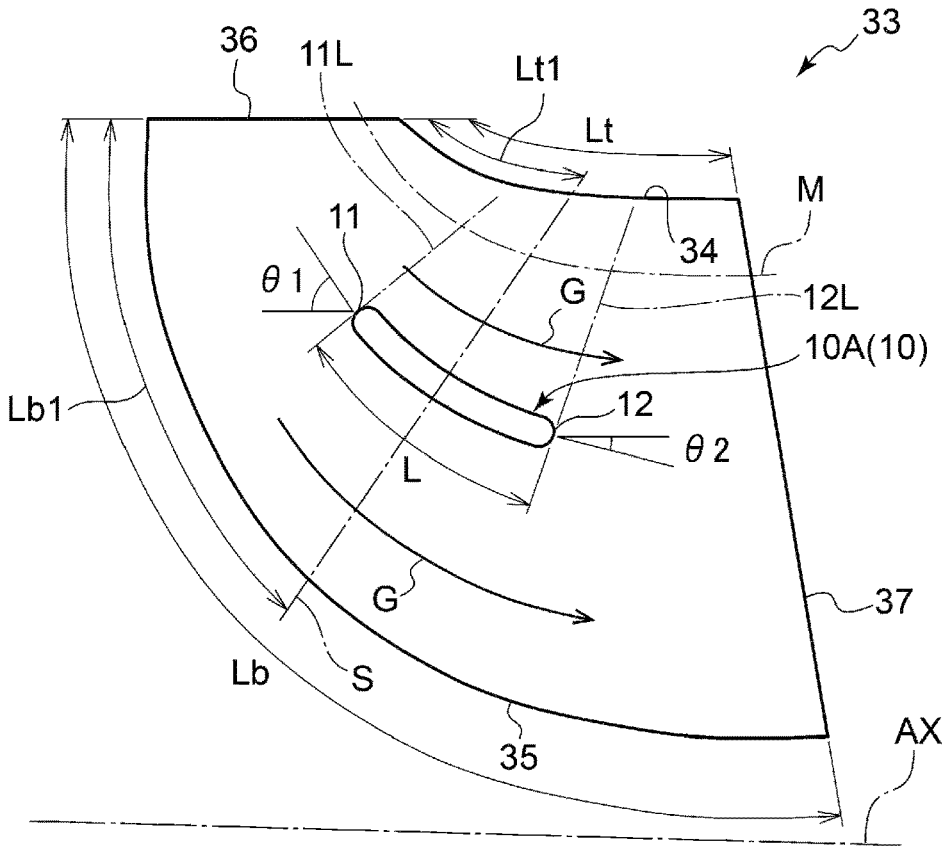
FIGS. 3A and 3B are schematic views showing the shape of a rotor blade according to an embodiment.

Herein, "span direction" is defined as a direction that passes through the first position and the second position, where Lt is the entire length of the tip portion 34 of the rotor blade 33, Lb is the entire length of the root portion 35 of the rotor blade 33 (connection position to the hub surface), the first position is a position on the tip portion 34 of the rotor blade 33 that is away from the leading edge 36 by a predetermined distance Lt1, and the second position is a position on the root portion 35 of the rotor blade 33 that is away from the leading edge 36 by a predetermined distance Lb1 (where Lb1=Lb×Lt1/Lt), as depicted in FIG. 3A. In FIGS. 3A to 6A and FIGS. 8 to 10, segment S along the span direction is illustrated as a single-dotted chain line.

As depicted in FIGS. 3 to 11, in some embodiments, each rib 10 extends in a direction that intersects with the span direction of the rotor blade 33, and thus it is possible to suppress secondary flow in the span direction along the blade surface of the rotor blade 33. Accordingly, it is possible to reduce pressure loss of exhaust gas being a working fluid, and improve the turbine efficiency. Furthermore, in each diagram, arrow G1 is an arrow that schematically indicates the flow of secondary flow, and arrow G2 is an arrow that schematically indicates the flow of secondary flow that the rib 10 suppresses.

Furthermore, as depicted in FIGS. 3 to 11, in some embodiments, each rib 10 reinforces the rotor blade 33, and thus it is possible to suppress vibration that occurs on the rotor blades 33.

Further, according to some embodiments, the turbocharger 1 includes a turbine blade according to some embodiments depicted in FIGS. 3 to 11, and thus it is possible to improve the turbine efficiency of the turbocharger 1 and suppress vibration that occurs on the rotor blades 33.

The vibration suppression effect achieved by the ribs 10 will be described below in detail.

In some embodiments depicted in FIGS. 3 to 11, as depicted in FIG. 3A for instance, in the meridional plane of the rotor blade 33, each rib 10 has an upstream end 11 being an end portion positioned at the side of the leading edge 36 and a downstream end 12 being an end portion positioned at the side of the trailing edge 37. That is, as depicted in FIG. 3A, the line (upstream side line 11L) along the span direction that passes the upstream end 11 is positioned closer to the leading edge 36 compared to the line (downstream side line 12L) along the span direction that passes the downstream end 12. The upstream end 11 of each rib 10 is formed so as to be oriented in a direction away from the axis AX. In some embodiments shown in FIGS. 3 to 7 and FIGS. 9 to 11, as depicted in FIG. 3A for instance, in the meridional plane of the rotor blade 33, each rib 10A is formed such that the extension direction of the rib 10 gradually becomes closer to the extension direction of the axis AX from the upstream end 11 toward the downstream end 12. In an embodiment depicted in FIG. 8, in the meridional plane of the rotor blade 33, the rib 10B includes an upstream portion 13 that extends lineally at the upstream side and a downstream portion 14 that extends lineally at the downstream side.

In some embodiments depicted in FIGS. 3 to 11, as depicted in FIG. 3A for instance, a relationship $\theta 1 > \theta 2$ is satisfied, where $\theta 1$ is an angular degree of an acute angle formed by the first direction in which the upstream end 11 of the rib 10 is oriented and a direction parallel to the axis AX, and $\theta 2$ is an angular degree of an acute angle formed by the second direction in which the downstream end 12 of the rib 10 is oriented and a direction parallel to the axis.

As described above, in some embodiments, with the upstream end 11 of each rib 10 oriented toward the upstream side of the flow of exhaust gas and the downstream end 12 of each rib 10 oriented toward the downstream side of the flow of exhaust gas, each rib 10 has a shape conforming to the flow of exhaust gas, and thereby it is possible to reduce pressure loss of exhaust gas.

In some embodiments depicted in FIGS. 3 to 7, and FIGS. 9 to 11, each rib 10A has, in the meridional plane of the rotor blade 33, an arc shape that protrudes toward the axis AX, and thus each rib 10A has a shape conforming to the flow of the working fluid, whereby it is possible to reduce pressure loss of the working fluid.

In some embodiments depicted in FIGS. 3 to 11, at least a part of each rib 10 extends, in the meridional plane of the rotor blade 33, along the meridional line of the rotor blade 33.

Herein, "meridional line" is defined as a line whose height position in the span direction is constant from the leading edge 36 to the trailing edge 37 of the rotor blade 33 in the meridional plane. In FIG. 3A, a meridional line M is illustrated as a single-dotted chain line.

Accordingly, with at least a part of each rib 10 extending along the meridional line M of the rotor blade 33, each rib 10 has a shape conforming to the flow of exhaust gas, and thereby it is possible to reduce pressure loss of exhaust gas.

Figure 3B:
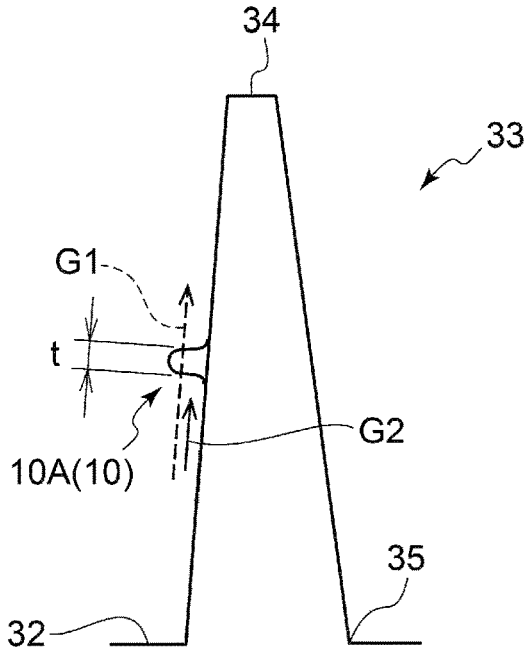

In some embodiments depicted in FIGS. 3 to 11, as depicted in FIGS. 3A and 3B for instance, each rib 10 is configured so as to satisfy a relationship $L \geq 2t$, where L is the length of the rib 10 in the meridional plane and 't' is the thickness of the rib 10.

Accordingly, it is possible to suppress the secondary flow in a broad range with the rib 10 having the length L. Furthermore, with the thickness 't' of the rib 10 satisfying the relationship $L \geq 2t$, it is possible to suppress the thickness of the rib 10 and suppress the weight increase of the turbine blade 3 despite formation of the rib 10.

Figure 12:
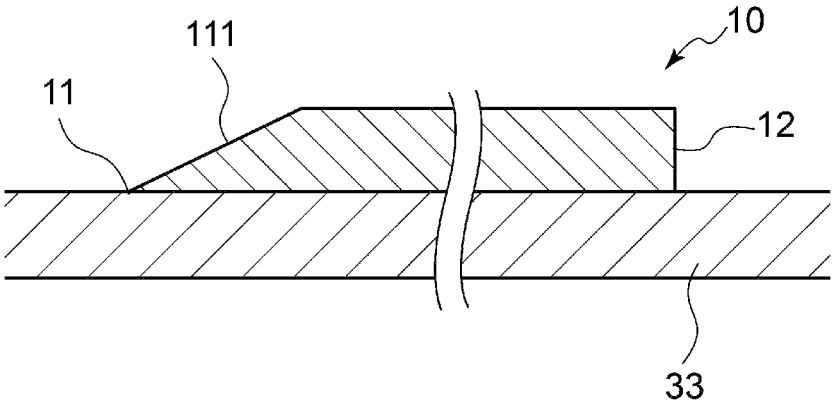
FIG. 12 is a view showing an example of the cross-sectional shape of a rib, taken along the height direction of the rib.

FIG. 12 is a view showing an example of the cross-sectional shape of the rib 10, taken along the height direction of the rib 10. As depicted in FIG. 12, an oblique portion 111 whose height gradually increases from the upstream end 11 toward the downstream side may be disposed at the upstream side of the rib 10 that is formed along the flow of exhaust gas.

Accordingly, it is possible to reduce pressure loss of exhaust gas more efficiently compared to a case where the rib 10 does not include the oblique portion 111.

Furthermore, an oblique portion (not depicted) whose height gradually decreases from the upstream side toward the downstream end 12 may be disposed at the downstream side of the rib 10 that is formed along the flow of exhaust gas.

Furthermore, the height of the rib 10 may not necessarily be constant at a portion other than the oblique portion 111 at the upstream side and the oblique portion at the downstream side.

Furthermore, a single rib 10 may be disposed at one location of a rotor blade 33, or a plurality of ribs 10 may be disposed at different locations of a rotor blade 33. For instance, a plurality of ribs 10 may be disposed on one of the pressure surface 38 or the suction surface 39 of the rotor blade 33, or at least one rib 10 may be disposed on each of the pressure surface 38 and the suction surface 39.

Furthermore, at least one rib 10 may be disposed on at least one of the plurality of rotor blades 33. Furthermore, ribs 10 having the same shape may be disposed on the respective rotor blades 33, or the ribs 10 may have different shapes depending on the rotor blades 33.

For instance, as depicted in FIG. 9, a plurality of ribs 10A may be disposed so as to extend in series along the flow direction of exhaust gas. While two ribs 10A are provided in the embodiment depicted in FIG. 9, the number of ribs 10A may be three or more. In the embodiment depicted in FIG. 9, a plurality of ribs 10A may be disposed along the meridional line M as depicted in the drawing.

In the embodiment depicted in FIG. 9, of the two ribs 10A, L91 is the length of the upstream rib 10A in the meridional plane and L92 is the length of the downstream rib 10A in the meridional plane. In the embodiment depicted in FIG. 9, the sum of the length L91 and the length L92 may be smaller than the length L of the single rib 10A depicted in FIG. 3A, for instance.

Furthermore, as depicted in FIG. 10 for instance, a plurality of ribs 10A may be disposed so as to extend in parallel along the flow direction of exhaust gas. While two ribs 10A are provided in the embodiment depicted in FIG. 10, the number of ribs 10A may be three or more.

Furthermore, as depicted in FIG. 10, the plurality of ribs 10A may be disposed so that the ribs 10A at least partially overlap with one another along the flow of exhaust gas, that is, so that the ribs 10A at least partially overlap when seen in a span direction. Furthermore, as depicted in FIG. 11, the plurality of ribs 10A may be disposed so that the ribs 10A do not overlap with one another along the flow of exhaust gas, that is, so that the ribs 10A do not overlap when seen in a span direction.

In the embodiment depicted in FIG. 10, of the two ribs 10A, L101 is the length of the rib 10A at the side of the root portion 35 in the meridional plane, and L102 is the length of the rib 10A at the side of the tip portion 34 in the meridional plane. In the embodiment depicted in FIG. 10, the sum of the length L101 and the length L102 may be smaller than the length L of the single rib 10A depicted in FIG. 3A, for instance.

In the embodiment depicted in FIG. 11, of the two ribs 10A, L111 is the length of the rib 10A at the side of the root portion 35 in the meridional plane and L112 is the length of the rib 10A at the side of the tip portion 34 in the meridional plane. In the embodiment depicted in FIG. 11, the sum of the length L111 and the length L112 may be smaller than the length L of the single rib 10A depicted in FIG. 3A, for instance.

For instance, by providing a plurality of ribs 10 as depicted in FIGS. 9 to 11, compared to a case where a single long rib 10 is provided, it is possible to suppress the weight increase of the turbine blade 3 despite formation of the rib 10A by forming short ribs 10A at a plurality of locations where secondary flow can be suppressed efficiently.

(Formation Position of the Rib 10 in the Span Direction)

Figure 4A:
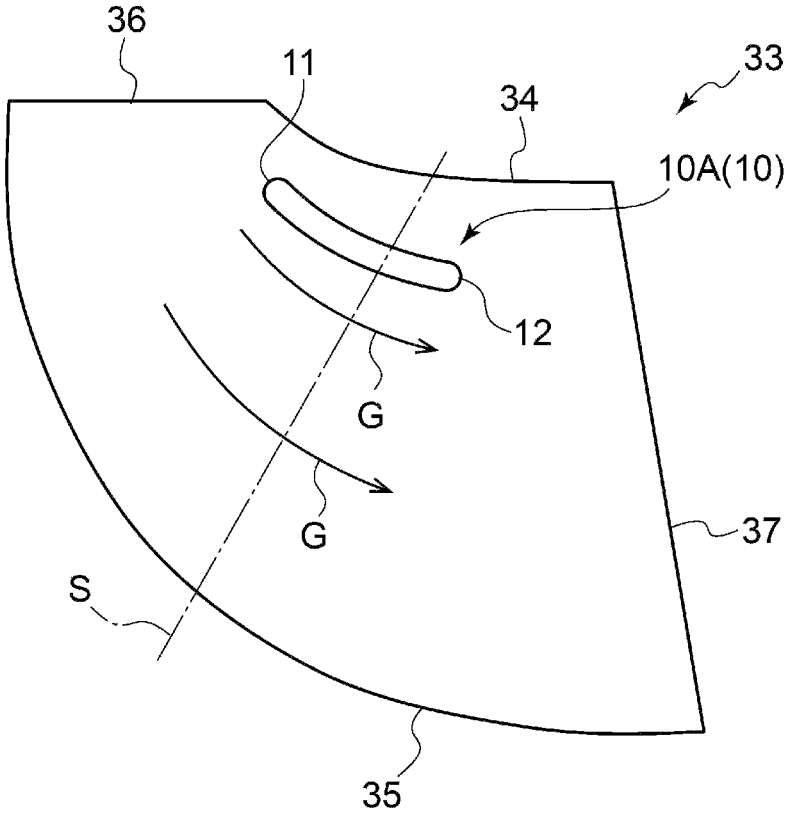
FIGS. 4A and 4B are schematic views showing the shape of a rotor blade according to an embodiment.
Figure 4B:
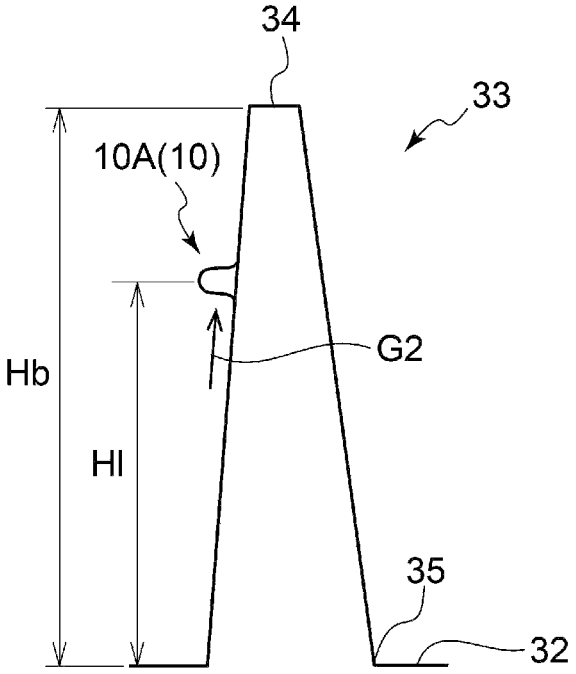

As depicted in FIG. 4, in the meridional plane of the rotor blade 33, Hb is the entire height of the rotor blade 33 in the span direction, and HI is the height from the hub surface 32 to the rib 10 in the span direction. In some embodiments, the at least one rib 10 is formed on a position that satisfies a relationship Hl>0.5×Hb.

The influence of loss due to the secondary flow is more significant at the side of the tip portion 34 of the rotor blade 33 than at the side of the root portion 35 of the rotor blade 33. Further, the length of the rotor blade 33 in the meridional line decreases from the root portion 35 toward the tip portion 34. Thus, even though the rib 10 has the same length, the influence of loss due to secondary flow can be suppressed more efficiently when the rib 10 is formed at the side of the tip portion 34, compared to a case where the rib 10 is formed at the side of the root portion 35.

In this regard, in the embodiment depicted in FIG. 4, since the rib 10 is formed on a position that satisfies Hl>0.5×Hb, the rib 10 is formed on a position closer to the tip portion 34 than to the root portion 35 on the blade surface, and thus it is possible to suppress the influence of loss due to the secondary flow effectively.

Furthermore, vibration that occurs on the rotor blade 33 tends to deform more largely at the side of the tip portion 34 as described below, and thus it is possible to suppress vibration that occurs on the rotor blade 33 effectively by forming the rib 10 on a position closer to the tip portion 34 than to the root portion 35 on the blade surface.

(Rib 10 Disposed at the Side of the Suction Surface 39)

Figure 5A:
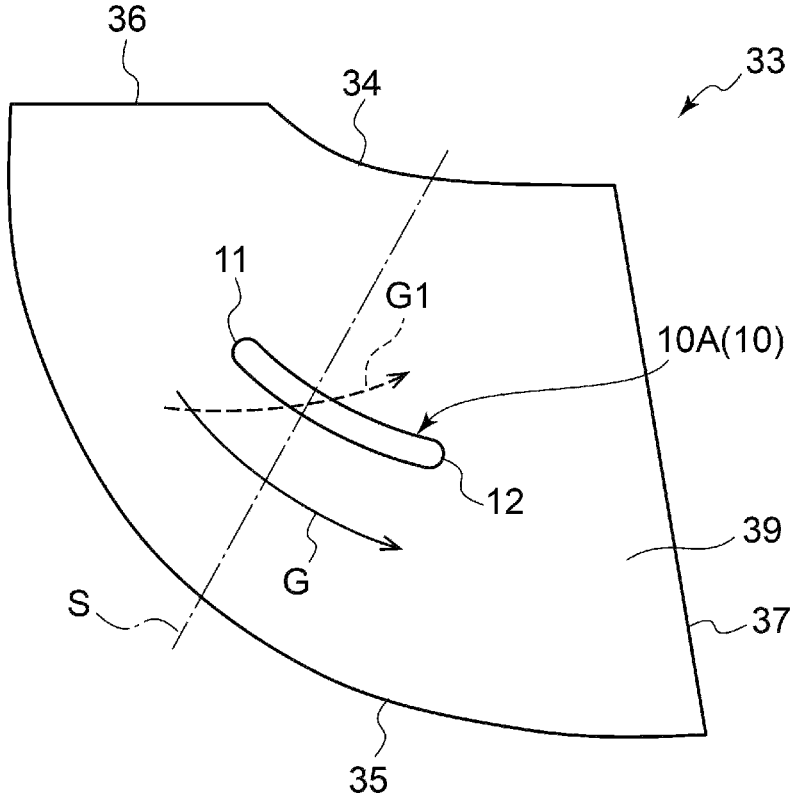
FIGS. 5A and 5B are schematic views showing the shape of a rotor blade according to an embodiment.
Figure 5B:
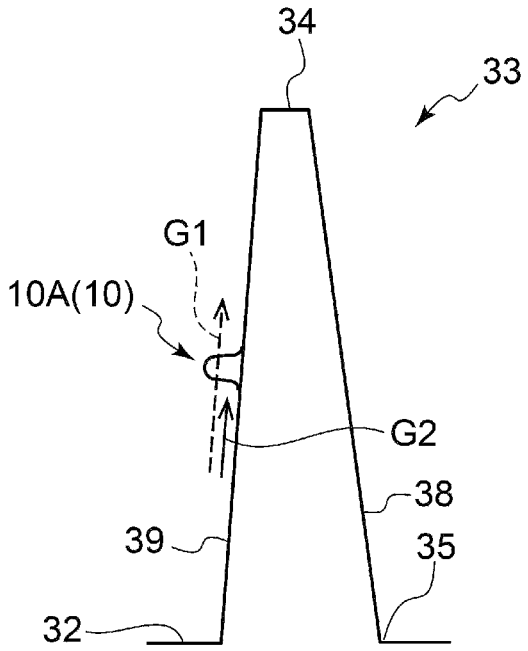
Figure 6A:
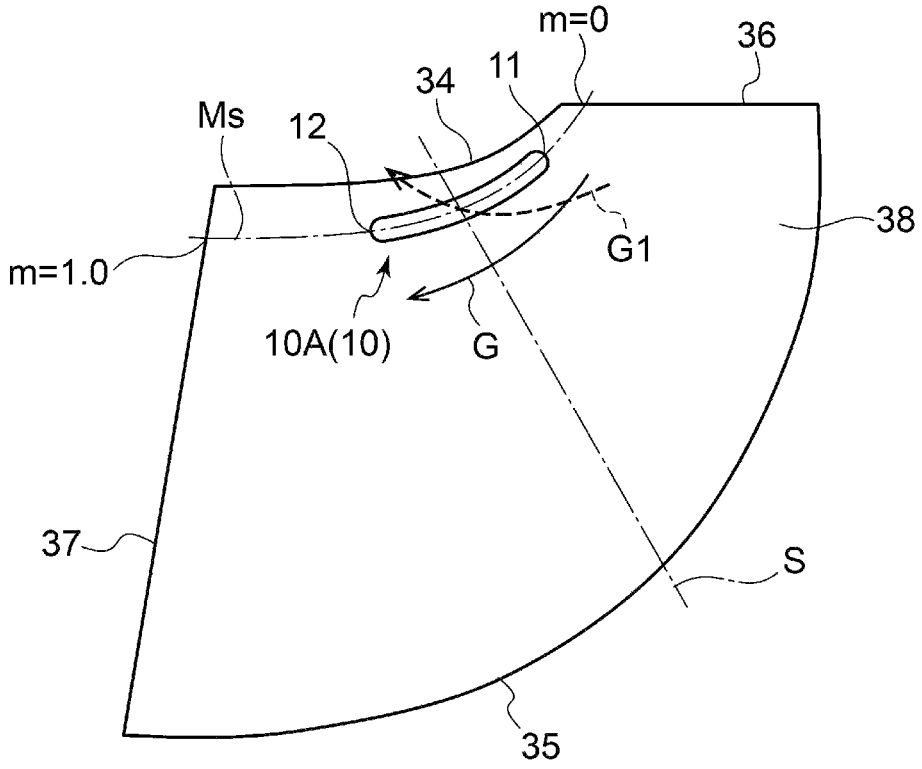
FIGS. 6A and 6B are schematic views showing the shape of a rotor blade according to an embodiment.
Figure 6B:
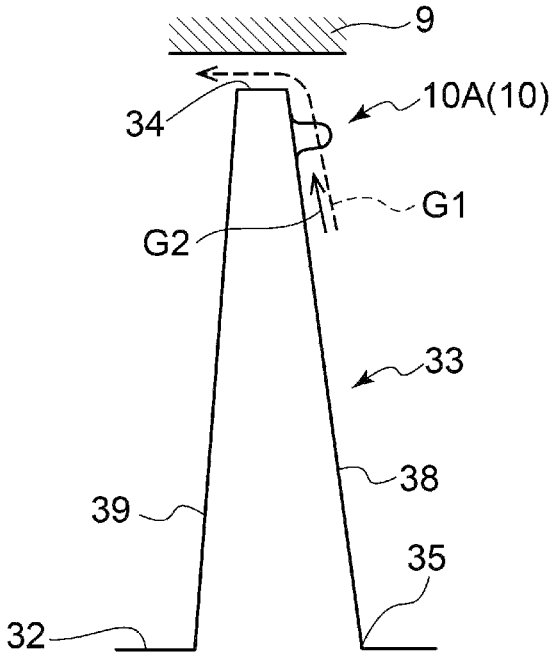

In some embodiments, as depicted in FIG. 5, the rib 10 is formed on the blade surface at the side of the suction surface of the rotor blade 33.

At the side of the suction surface 39 of the rotor blade 33, secondary flow flowing along the blade surface from the root portion 35 toward the tip portion 34 causes problems. In this regard, as depicted in FIG. 5, it is possible to suppress the secondary flow at the side of the suction surface 39 and suppress loss by forming the rib 10 on the blade surface at the side of the suction surface 39 of the rotor blade 33.

(Rib 10 Disposed at the Side of the Pressure Surface 38)

Further, in some embodiments, as depicted in FIG. 6, the rib 10 is formed near the tip portion 34 on the blade surface at the side of the pressure surface 38 of the rotor blade 33.

Herein, the position near the tip portion 34 is a position that satisfies a relationship Hl>0.7×Hb, and more preferably, a position that satisfies a relationship Hl>0.9×Hb. Furthermore, forming the rib 10 near the tip portion 34 on the blade surface at the side of the pressure surface 38 of the rotor blade 33 includes forming the rib 10 on the tip portion 34 (Hl=1.0×Hb).

A tip clearance exists between the tip portion 34 of the rotor blade 33 and the shroud 9. At the side of the pressure surface 38 of the rotor blade 33, clearance flow causes problems, when a working fluid flows to the suction surface 39 from the pressure surface 38 via the tip clearance. Occurrence of clearance flow leads to deterioration of the turbine efficiency and generation of loss.

In this regard, as depicted in FIG. 6, it is possible to suppress the clearance flow and suppress loss by forming the rib 10 near the tip portion 34 on the blade surface at the side of the pressure surface 38 of the rotor blade 33.

Furthermore, the rib 10 in an embodiment depicted in FIG. 6 may have the following configuration.

That is, in the meridional plane of the rotor blade 33, the meridional line that passes the region on the blade surface on which the rib 10 is formed is defined as the reference meridional line Ms. Further, the region may be configured so as to include a portion where the blade surface has the maximum curve degree on the reference meridional line Ms.

Figure 13:
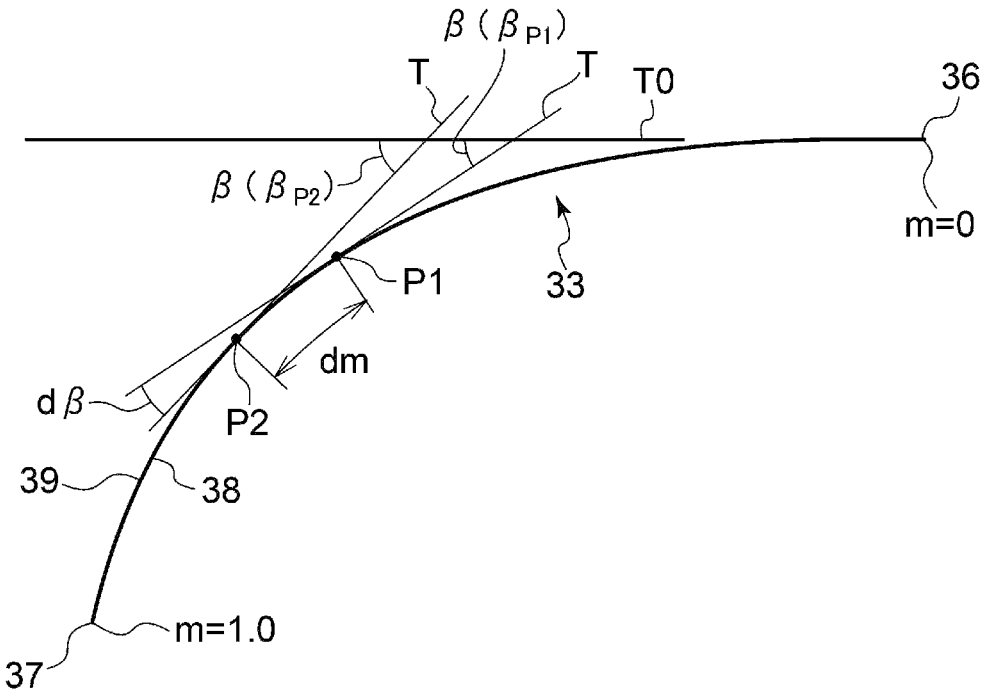
FIG. 13 is an expansion diagram of the shape of the rotor blade along the reference meridional line as seen in the span direction.

Herein, the portion where the blade surface has the maximum curve degree on the reference meridional line Ms will be described. FIG. 13 is an expansion view of the shape of the rotor blade 33 along the reference meridional line Ms as seen in the span direction. That is, the curve in FIG. 13 indicates the shape of the rotor blade 33 in FIG. 13, and each position on the curve is seen in the span direction at each position. In FIG. 13, the thickness of the rotor blade 33 is not considered.

For instance, in FIGS. 6 and 13, the position on the reference meridional line Ms is indicated by a value of variant 'm', where the position 'm' corresponding to the leading edge 36 on the reference meridional line Ms is zero (m=0), and the position 'm' corresponding to the trailing edge 37 on the reference meridional line Ms is 1.0 (m=1.0).

In FIG. 13, the right end corresponds to the position m=0, and the left end corresponds to the position m=1.0.

In FIG. 13, for instance, the angle formed between tangent T0 at position m=0 of the curve indicating the shape of the rotor blade 33 and tangent T at a position other than position m=0 is referred to as angle β of the blade surface on the reference meridional line Ms of the position. In the following description, angle β of the blade surface on the reference meridional line Ms is also referred to as merely angle β.

The angle β gradually changes along the reference meridional line Ms. When dβ is the change amount of angle β in the small section dm along the reference meridional line Ms, the curve degree of the blade surface on the reference meridional line Ms can be represented by a relationship dβ/dm. For instance, in FIG. 13, when $\beta_{P1}$ is the angular degree β of the blade surface at position P1 where m=a (where 0<a<1.0) and $\beta_P2$ is the angular degree β on the blade surface at position P2 where m=a+dm, the curve degree of the rotor blade 33 at position P1 can be represented by a relationship $d\beta/dm=(\beta_{P2}-\beta_{P1})/dm$. For the purpose of illustration, the distance between the positions P1 and P2 are enlarged in FIG. 13.

The above described clearance flow tends to become greater at a section where the curve degree on the blade surface on the meridional line is large. That is, as the curve degree of the blade surface on the meridional line increases, the difference between the main flow of exhaust gas from the upstream side toward the downstream side and the extension direction of the blade surface increases. Thus, for instance on the pressure surface 38, as the curve degree of the blade surface on the meridional line increases, the pressure of exhaust gas tends to increase. Thus, as the curve degree of the blade surface on the meridional line increases, the exhaust gas flows more easily in a direction other than the above main flow direction, and the clearance flow increases.

In this regard, with the region on the blade surface where the rib 10 is formed including a section where the curve degree dβ/dm of the blade surface on the reference meridional line Ms reaches its maximum as in the embodiment depicted in FIG. 6, the rib 10 is formed on a position where clearance flow has a high rate. Accordingly, it is possible to suppress clearance flow effectively and suppress loss.

(Ribs 10 Disposed at the Side of the Pressure Surface 38 and at the Side of the Suction Surface 39)

In the embodiment depicted in FIG. 7, the ribs 10 include a suction-surface side rib 109 formed on the blade surface at the side of the suction surface 39 of the rotor blade 33 and a pressure-surface side rib 108 formed on the blade surface at the side of the pressure surface 38.

In FIG. 7, Hln is the height from the hub surface 32 to the suction-surface side rib 109 in the span direction, and Hlp is the height from the hub surface 32 to the pressure-surface side rib 108 in the span direction.

Further, in the embodiment depicted in FIG. 7, a relationship Hln<Hlp is satisfied.

Accordingly, it is possible to suppress secondary flow at the side of the suction surface 39 with the suction-surface side rib 109 and reduce loss. Further, with the pressure-surface side rib 108 formed closer to the tip portion 34 of the rotor blade 33 than the suction-surface side rib 109, it is possible to suppress the above described clearance flow effectively and reduce loss. Furthermore, with the suction-surface side rib 109 and the pressure-surface side rib 108 having different heights from the hub surface 32 in the span direction, it is possible to suppress vibration in a broad range of the rotor blade 33.

(Vibration of the Rotor Blade 33)

Figure 14:
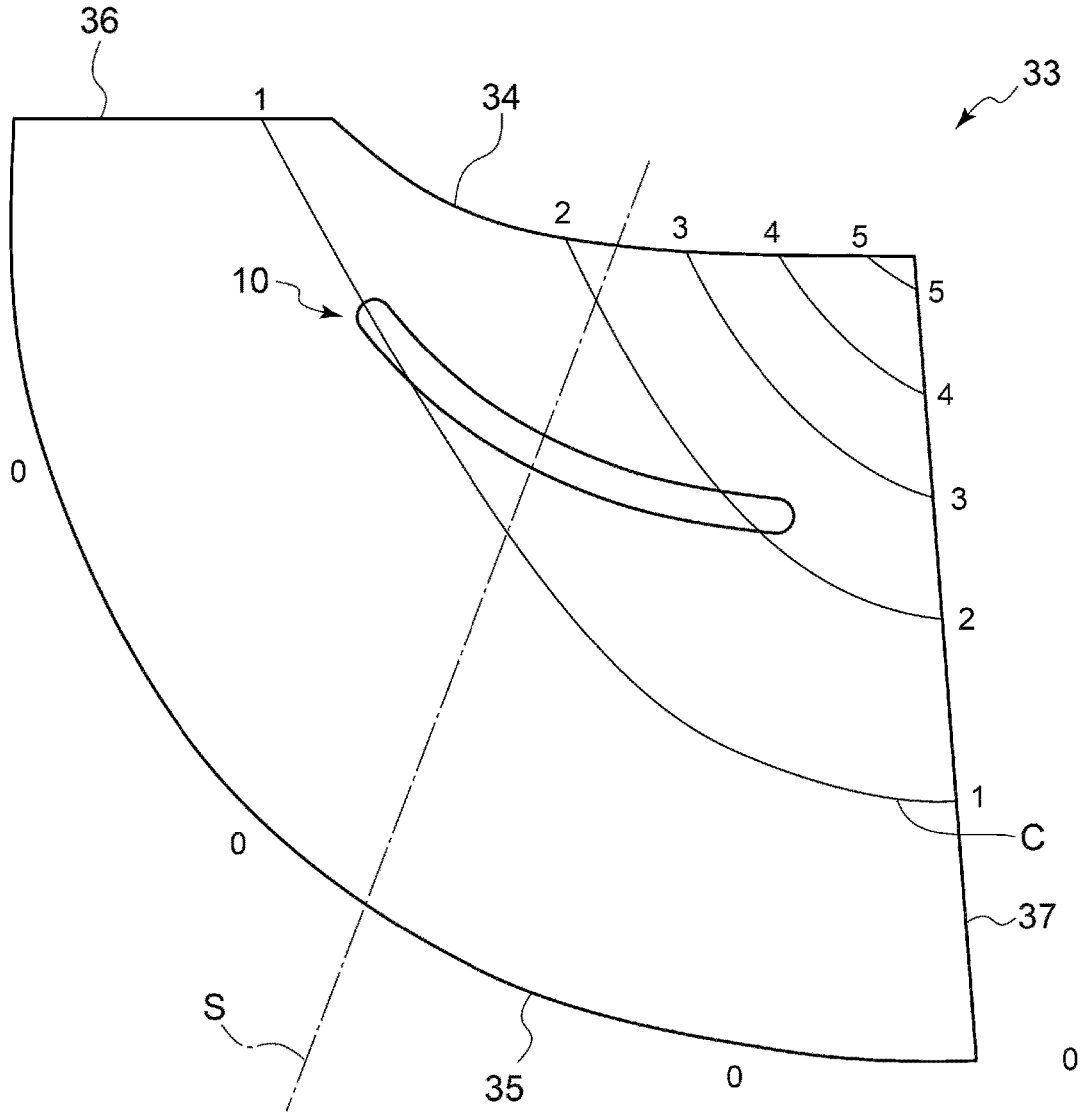
FIG. 14 is a diagram showing an example of a level curve of the amplitude in a case where primary-mode vibration occurs on the rotor blade.
Figure 15:
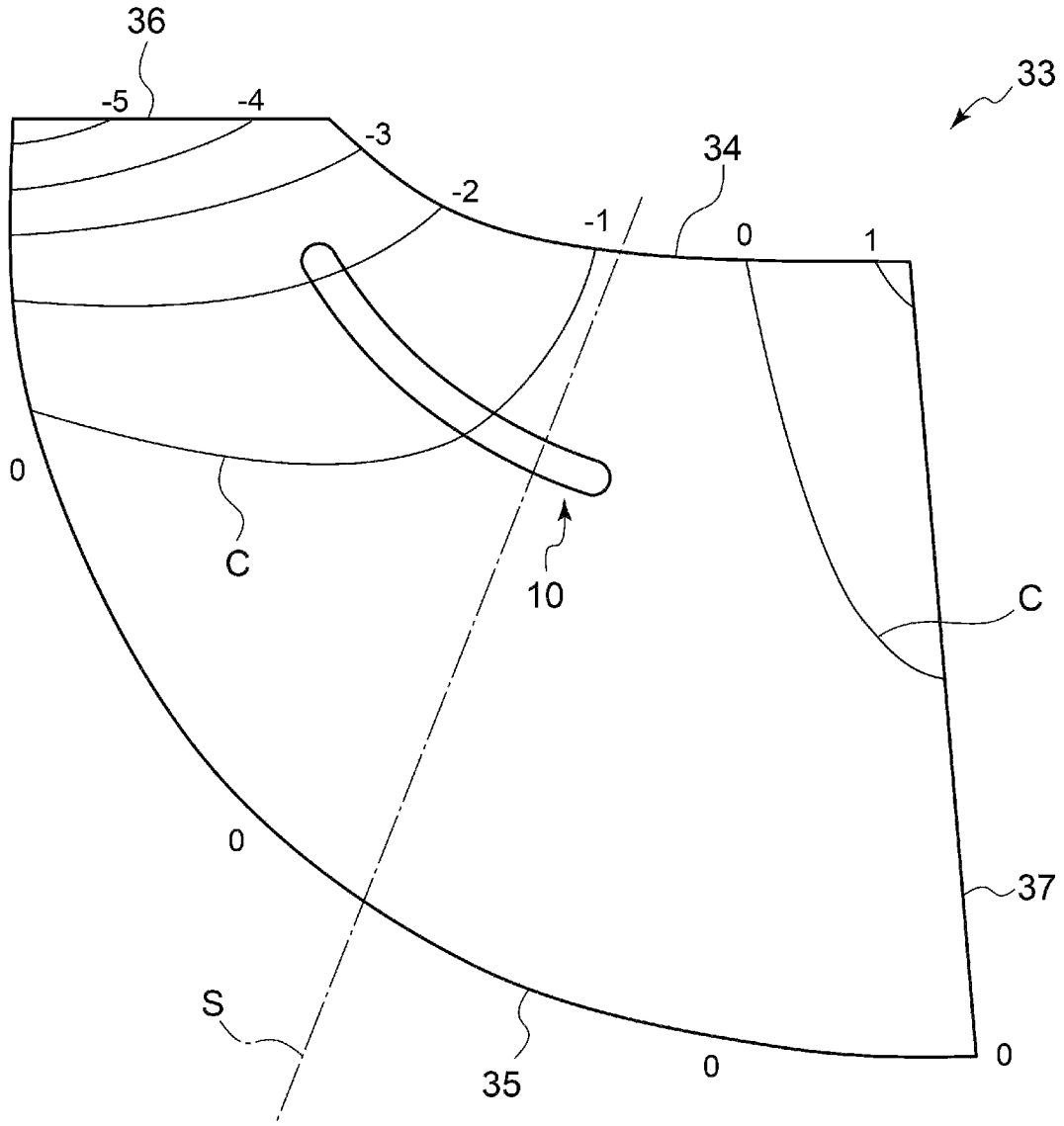
FIG. 15 is a diagram showing an example of a level curve of the amplitude in a case where secondary-mode vibration occurs on the rotor blade.
Figure 16:
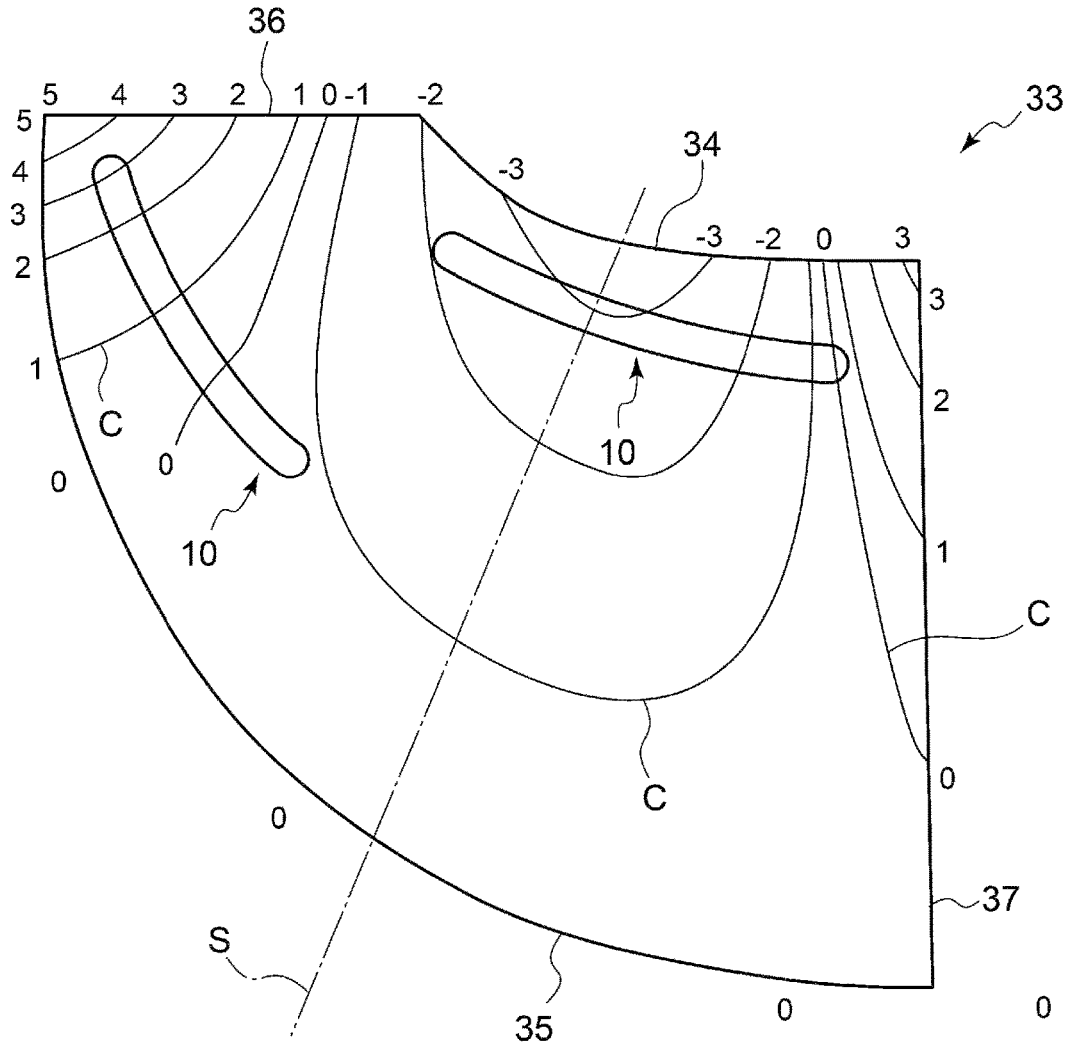
FIG. 16 is a diagram showing an example of a level curve of the amplitude in a case where tertiary-mode vibration occurs on the rotor blade.

Vibration of the rotor blade 33 according to some embodiments will be described. According to some embodiments, vibration occurs on the rotor blade 33 in different vibration modes. For instance, FIG. 14 is a diagram showing an example of a level curve of amplitude in a case where primary-mode vibration occurs on the rotor blade 33. For instance, FIG. 15 is a diagram showing an example of a level curve of amplitude in a case where secondary-mode vibration occurs on the rotor blade 33. For instance, FIG. 16 is a diagram showing an example of a level curve of amplitude in a case where tertiary-mode vibration occurs on the rotor blade 33. Furthermore, the values indicated near the end portion of the level curve C is are relative values that represent the magnitude of amplitude, where greater absolute values represent greater amplitudes. Further, the plus and minus signs of the values indicate the directions of the amplitude. The section with positive values and the section with negative values have opposite amplitude directions. As depicted in FIGS. 14 to 16, vibration that occurs on the rotor blade 33 tends to deform considerably at the side of the tip portion 34.

Further, in the rotor blade 33 in FIGS. 14 to 16, a part at the side of the leading edge 36 protrudes outward from the hub 31 in the circumferential direction, and the root portion 35 near the leading edge 36 is not fixed to the hub surface 32.

As depicted in FIGS. 14 to 16, the rib 10 that extends in a direction that intersects with the span direction of the rotor blade 33 also intersects with the level curve of the amplitude of vibration that occurs on the rotor blade 33. Thus, it is possible to suppress vibration that occurs on the rotor blade 33 effectively with the rib 10.

(Density of the Rib 10)

In some embodiments, the rotor blade 33 and the rib 10 are formed of the same metal material, and the rib 10 has a smaller density than the rotor blade 33.

In the turbine blade 3, the strength required for the rotor blade 33 and the strength required for the rib 10 are different. That is, the rotor blade 33 needs to have a high strength to resist a centrifugal force.

On the other hand, the rib 10 formed on the rotor blade 33 does not need to be as strong as the rotor blade 33, as the rotor blade 33 has a high strength. Thus, it is desirable to suppress the weight of the rib 10 to suppress a weight increase of the turbine blade 3.

Furthermore, in a case where the rotor blade 33 and the rib 10 are formed integrally in the turbine blade 3, to suppress the weight of the rib 10, the density of the rib 10 may be reduced compared to the density of the rotor blade 33 by changing the density between the rib 10 and the rotor blade 33.

For instance, in a case where metal powder is irradiated with laser to produce the turbine blade 3 through additive manufacturing of the metal powder, small voids may be formed inside the rib 10 so that the rib 10 has a smaller density than the rotor blade 33.

In some embodiments, with the rib 10 having a smaller density than the rotor blade 33, it is possible to suppress the weight of the rib 10, and suppress weight increase of the turbine blade 3.

(Method of Producing the Turbine Blade 3)

As described above, the turbine blade 3 according to some embodiments is produced through additive manufacturing of metal powder, by using a device called a metal 3D printer and irradiating metal powder with laser. In this production method, additive manufacturing of metal powder is carried out by locally melting metal powder with laser and then solidifying the metal powder in laminated layers.

That is, the method of producing a turbine blade according to some embodiments is a method of producing the hub 31, the rotor blade 33, and the rib 10 integrally through additive manufacturing of metal powder.

Additive manufacturing of metal powder can be carried out by laser sintering, laser melting, and the like.

As described above, the turbocharger 1 according to some embodiments is a small turbocharger for a vehicle such as a car. The turbine blade 3 according to some embodiments have a diameter of not less than 20 mm and not more than 70 mm. Typically, turbine blades of this size have been produced by casting.

Meanwhile, for instance, the above described Patent Documents 2 to 4 disclose techniques to produce a turbine blade of an axial-flow turbine such as a gas turbine and a steam turbine, by metal additive manufacturing. However, the Patent Documents are about producing a turbine blade, which is a part of an axial turbine, by metal additive manufacturing, and not producing an axial-flow turbine as a whole including a rotor. Typically, for radial turbines and mixed-flow turbines used for a small turbocharger for a vehicle such as a car, the turbine blade, the hub, and the blade have not been produced integrally by additive manufacturing.

For instance, when producing a turbine blade by casing, wax is injected into a mold, and a wax mold is produced. The wax mold needs to be removed from the mold, and thus a protruding portion or the like that extends in a direction that intersects with the direction of mold removal cannot be disposed on the position of the wax mold that corresponds to the surface of the turbine blade. Thus, fine casting is not suitable to producing a turbine blade 3 that has a rib 10 formed on the blade surface extending in a direction that intersects with the span direction of the rotor blade 33 in the meridional plane of the rotor blade 33 like the turbine blade 3 of the above described embodiments.

In this regard, additive manufacturing of metal powder makes it possible to produce a turbine blade 3 including a rib 10 extending on the blade surface by integrally forming the hub 31, the rotor blade 33, and the rib 10 extending in a direction that intersects with the span direction of the rotor blade 33.

Embodiments of the present invention were described in detail above, but the present invention is not limited thereto, and various amendments and modifications may be implemented.

For instance, in the above description, ribs 10 having the same shape may be disposed on the respective rotor blades 33, or the ribs 10 may have different shapes depending on the rotor blades 33. However, the present invention is not limited to this. For instance, when providing a plurality of ribs 10 for a single rotor blade 33, the ribs may have different shapes.

For instance, the ribs 10 depicted in FIGS. 3, 8 to 11 may be provided in a suitable combination for a single rotor blade 33.

REFERENCE SIGNS LIST

1 Turbocharger
3 Turbine wheel (turbine blade)
9 Shroud
10, 10A, 10B Rib
11 Upstream end
12 Downstream end
31 Hub
32 Hub surface
33 Rotor blade
34 Tip portion (tip)
35 Root portion
36 Leading edge
37 Trailing edge
38 Pressure surface
39 Suction surface
111 Oblique portion

The invention claimed is:

1. A turbine blade configured to be coupled to a rotational shaft and rotated around an axis, the turbine blade comprising:

a hub having a hub surface which is inclined with respect to the axis in a cross section along the axis a rotor blade disposed on the hub surface;

at least one rib formed on a blade surface of the rotor blade, the at least one rib extending in a direction which intersects with a span direction of the rotor blade in a meridional plane of the rotor blade, wherein, in the meridional plane of the rotor blade, the at least one rib is formed on a position which satisfies a relationship $Hl>0.5\times Hb$, where Hb is an entire height of the rotor blade in the span direction and Hl is a height from the hub surface to the at least one rib in the span direction, wherein the at least one rib includes:

a suction-surface side rib formed on a suction-surface side blade surface of the rotor blade and farthest from the hub surface; and a pressure-surface side rib formed on a pressure-surface side blade surface of the rotor blade and farthest from the hub surface, and wherein, in the meridional plane of the rotor blade, a relationship $Hln<Hlp$ is satisfied, where Hln is a height from the hub surface to the suction-surface side rib in the span direction and Hlp is a height from the hub surface to the pressure-surface side rib in the span direction.

2. The turbine blade according to claim 1, wherein, in the meridional plane of the rotor blade, the at least one rib has an upstream end formed so as to be oriented in a first direction which is a direction away from the axis and a downstream end formed so as to be oriented in a second direction, and a relationship $\theta 1>\theta 2$ is satisfied, where $\theta 1$ is an angular degree of an acute angle formed by the first direction and a direction parallel to the axis, and $\theta 2$ is an angular degree of an acute angle formed by the second direction and the direction parallel to the axis.

3. The turbine blade according to claim 1, wherein the at least one rib has an arc shape protruding toward the axis in the meridional plane of the rotor blade.

4. The turbine blade according to claim 1, wherein at least a part of the at least one rib extends along a meridional line of the rotor blade in the meridional plane of the rotor blade.

5. The turbine blade according to claim 1, wherein the at least one rib is configured to satisfy a relationship $L\geq 2t$, where L is a length of the at least one rib in the meridional plane and 't' is a thickness of the at least one rib.

6. The turbine blade according to claim 1, wherein the at least one rib has an oblique portion whose height increases gradually from an upstream end of the at least one rib toward a downstream side.

7. The turbine blade according to claim 1, wherein the at least one rib is formed on the pressure-surface side blade surface of the rotor blade and at a position which satisfies a relationship $Hl>0.7\times Hb$.

8. The turbine blade according to claim 7, wherein, in the meridional plane of the rotor blade, when a reference meridional line is a meridional line which passes a region of the blade surface where the at least one rib is formed, the region includes a section where a curve degree of the blade surface on the reference meridional line is maximum.

9. The turbine blade according to claim 1, wherein the rotor blade and the at least one rib comprise the same metal material, and wherein the at least one rib has a smaller density than the rotor blade.

10. A turbocharger, comprising:

a rotational shaft;

a compressor wheel coupled to a first end side of the rotational shaft; and a turbine blade according to claim 1, coupled to a second end side of the rotational shaft.

11. A method of producing a turbine blade according to claim 1, comprising:

forming the hub, the rotor blade, and the at least one rib integrally by additive manufacturing of metal powder.

* * * * *